US008203131B2

(12) United States Patent
Silverman et al.

(10) Patent No.: US 8,203,131 B2
(45) **Date of Patent: *Jun. 19, 2012**

(54) LIMITING PLATE SHIFTING WITHIN A PLATE PALLET

(75) Inventors: Mark Silverman, Tel-Aviv (IL); Pavel Korolik, Petah-Tikwa (IL)

(73) Assignee: Eastman Kodak Company, Rochester, NY (US)

( * ) Notice: Subject to any disclaimer, the term of this patent is extended or adjusted under 35 U.S.C. 154(b) by 365 days.

This patent is subject to a terminal disclaimer.

(21) Appl. No.: 12/563,462

(22) Filed: Sep. 21, 2009

(65) Prior Publication Data

US 2011/0070060 A1 Mar. 24, 2011

(51) Int. Cl.
*B65H 7/02* (2006.01)

(52) U.S. Cl. ..... 250/559.3; 348/95

(58) Field of Classification Search ..... 414/782; 348/95; 250/559.3
See application file for complete search history.

(56) References Cited

U.S. PATENT DOCUMENTS

| | | | | |
|---|---|---|---|---|
| 3,735,884 | A * | 5/1973 | Klett | 414/498 |
| 4,765,606 | A | 8/1988 | Marass | |
| 4,797,989 | A * | 1/1989 | Cherko | 483/14 |
| 6,776,527 | B1 * | 8/2004 | Tybinkowski et al. | 378/209 |
| 2009/0224464 | A1 | 9/2009 | Korolik et al. | |
| 2010/0064921 | A1 * | 3/2010 | Korolik et al. | 101/474 |

FOREIGN PATENT DOCUMENTS

FR 2 866 869 A1 9/2005

* cited by examiner

*Primary Examiner* — Charles A Fox
(74) *Attorney, Agent, or Firm* — Nelson Adrian Blish

(57) ABSTRACT

An apparatus for aligning and inserting a plate stack (112) into an automatic plate loader (100) in a predefined position. A plate pallet (116) carries the plate stack. A plate pallet adapter (128) adapted to carry the plate pallet, a centering element (236, 264) attached to the plate pallet adapter aligns the plate stack in a center position relative to the plate pallet adapter. A guiding unit (216, 220, 224, 228, 232, 504, 712) is attached to the plate pallet adapter, configured to align to the plate pallet and guide the plate pallet adapter into the automatic plate loader. In one embodiment, a plate adapter positioning sensor (268) is configured to sense and notify (124) an operator when the pallet adapter reaches the predefined position (248).

10 Claims, 10 Drawing Sheets

LIMITING PLATE SHIFTING WITHIN A PLATE PALLET

CROSS REFERENCE TO RELATED APPLICATIONS

Reference is made to commonly-assigned copending U.S. patent application Ser. No. 12/045,058, now U.S. Publication No. 2009/0224464 and U.S. Pat. No. 7,888,664, filed Mar. 10, 2008, entitled PLATE PALLET ALLIGNMENT SYSTEM, by Korolik et al., the disclosure of which is incorporated herein.

FIELD OF THE INVENTION

The present invention relates to an apparatus and methods to properly insert originally packed printing plate pallets into a precise position inside a plate loader device. The plates are then loaded into a computer-to-plate imaging device.

BACKGROUND OF THE INVENTION

A variety of systems and applications use stacks of sheets or plates or both, which may be made of metal, paper, plastic, or the like. Printing plates (hereinafter singly or collectively referred to as "plates") are typically stacked in plate pallets which house the plates and facilitates their protection, transportation, and handling.

A system for handling printing plates will generally use cassettes having specific dimensions. Cassettes can usually be set to contain plates of various sizes, but all plates in the same cassette are of one size. The plates may be manually removed from the plate stack and inserted into the cassettes for use by the plate imaging system. Plates in a plate stack are separated by intermediate paper sheets, hereinafter referred to as separation paper.

Cassettes containing printing plates are heavy and bulky, and moving such cassettes requires complicated and expensive mechanisms and is time consuming; specifically, during the loading of the plates from the plate stacks into the cassettes. There is a widely recognized need for an automatic and efficient handling system for feeding plates directly from the original plate pallet into the imaging device, while obtaining and maintaining a precise position of the plates during the plate feeding process. This need is addressed by the invention described in commonly-assigned U.S. Publication No. 2009/0224464.

The plate stack received from plate manufacturers often comprises a stack of a few hundred plates. Each plate is separated from the next by separation paper, and the entire stack of plates is placed on a pallet. The stack of plates positioned on a pallet, are inserted as such into the plate loading system. The stack of plates must be inserted into the plate loading system precisely, in such a way that the plate pick up mechanism is perfectly aligned with a certain side of the plate stack and they are centered to.

The invention disclosed hereunder suggests a solution to the described problem.

SUMMARY OF THE INVENTION

Briefly, according to one aspect of the present invention an apparatus for aligning a plate stack and inserting the plate stack into an automatic plate loader in a predefined position in the automatic plate loader includes: a plate pallet adapted to carry the plate stack, a plate pallet adapter adapted to carry the plate pallet, a centering element attached to the plate pallet adapter configured to align the plate stack in a center position relative to the plate pallet adapter, a guiding unit attached to the plate pallet adapter configured to be aligned in respect to the plate pallet position and guide the plate pallet adapter into the automatic plate loader. In addition, a plate adapter positioning sensor is configured in the automatic plate loader adapted to sense and notify on reaching to the predefined position of the pallet adapter when inserted into the automatic plate loader.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

The present invention describes apparatus and methods to receive a stack of printing plates in an original manufactured form into an automatic pallet loader (APL). The plates are further fetched from the stack of plates on the pallet in the APL to be brought into a computer-to-plate (CTP) imaging device.

Figure 1A:
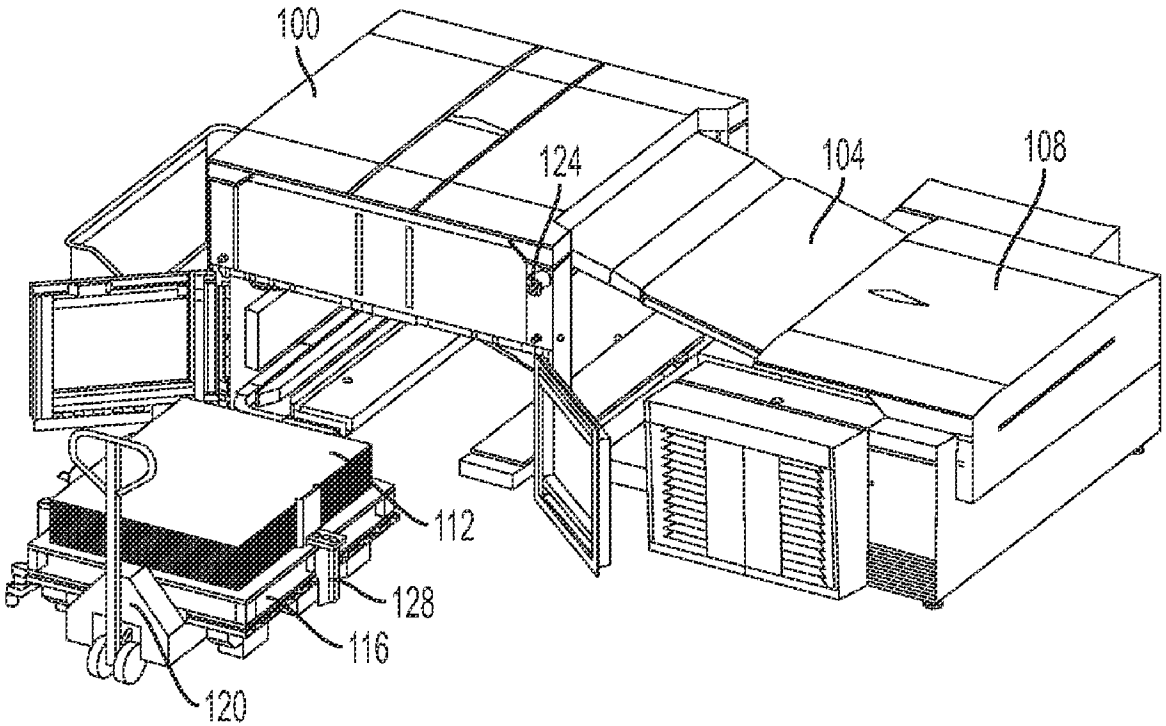
FIG. 1A (PRIOR ART)
FIG. 1A shows a prior art perspective view of a system configured with an imaging device connected to an automatic plate loader with a plate stack ready to be inserted.

FIG. 1A shows a typical configuration of an APL 100 connected inline to an imaging device 108, whereby plates from APL 100 are delivered to the imaging device 108 through a connecting plate tray 104.

Figure 2:
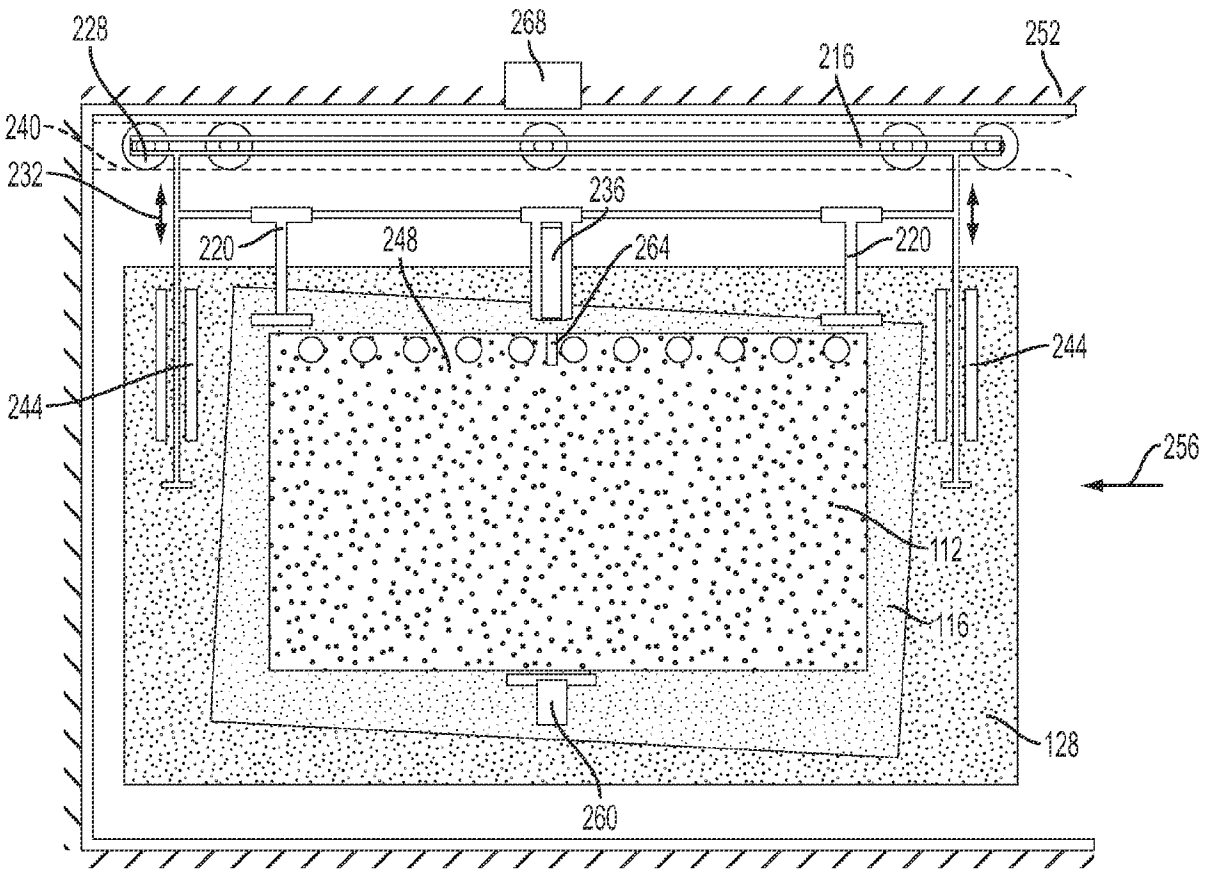
FIG. 2 is a schematic top view of a plate stack on a plate pallet inserted into an automatic pallet loader.

FIG. 2 shows a plate stack 112 positioned on a plate pallet 116. The plate stack 112 positioned on plate pallet 116 is delivered as a unit from the plates manufacture. The plate stack 112 with pallet 116 is inserted into APL 100 from loading direction 256, the entry point to APL 100 may be configured from either side of APL 100. Plate stack 112 position in the APL should be perfectly aligned with the plate pick up position 248 in the APL 100. In order to achieve a good alignment, the plate stack 112 with plate pallet 116 is placed on a plate pallet adapter 128 outside of the APL 100. Pallet alignment limiters 220, are attached to a guiding beam assembly 216. The guiding beam 216 is firmly attached to plate adapter 128 along one facet. Back limiter 260 are provided to secure plate stack 112 from the back side.

Figure 1B:
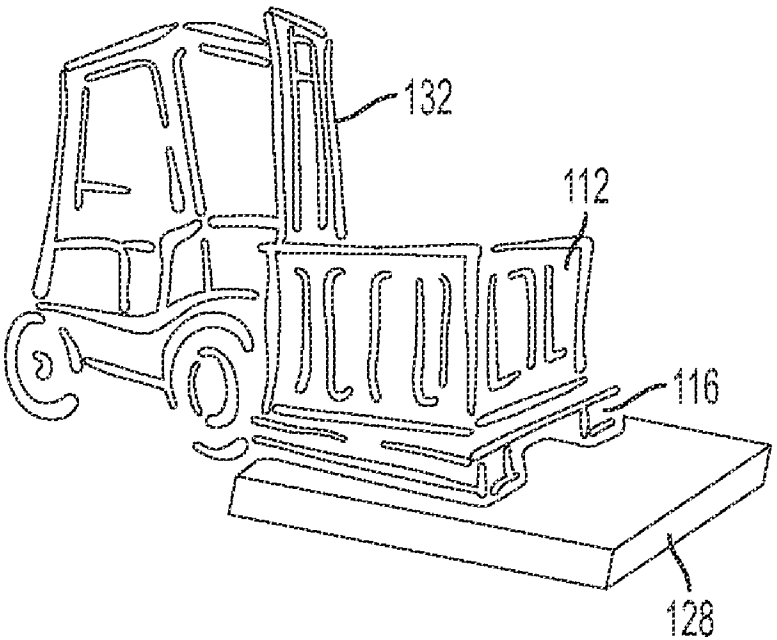
FIG. 1B (PRIOR ART)
FIG. 1B is a prior art perspective of a forklift with a plate stack on a plate pallet.

Pallet adapter 128 is positioned on pallet truck 120. A forklift 132 (as is shown in FIG. 1B) lifts the plate stack 112 with plate pallet 116 and holds it over plate pallet adapter 128, which is positioned on pallet truck 120. The front alignment limiters 220 and plate adapter are transported as a unit towards plate stack 112 until the front alignment limiters 220 fully touch one face of plate stack 112, and are perfectly aligned to both limiters 220. In addition, plate stack 112 will be symmetrically aligned to center marker 236, by the operator. The symmetrical alignment will make sure that plate stack center line 264 is aligned with plate centering mark 236. At this point the forklift 132 will release plate stack 112 with plate pallet 116 onto the surface of plate pallet adapter 128. The front alignment limiters 220 with guide beam 216 are pushed towards plate stack 112 and the slide and lock elements 244 are activated to prevent movement and to ensure that when plate pallet adapter 128 with the plate stack 112 is inserted into APL 100, the plate stack 112 will be perfectly aligned with APL's plate picker position 248.

At this stage, plate truck 120 carries the plate pallet adapter 128 with both plate stack 112 and plate pallet 116, positioned on the plate pallet adapter 128. The plate stack 112 and plate pallet 116 positioned on top of plate pallet adapter 128 are pushed by a pallet truck 120, shown in FIG. 1A, and transported into APL 100, by inserting guiding beam assembly 216 with rollers 228 of the plate pallet adapter 128 into slot 240. Adapter positioning sensor 268 is attached to APL chassis 252. Adapter positioning sensor 268 helps the operator to position at which pallet adapter 128 into APL 100. Adapter positioning sensor 268 detects pallet centering mark 236 and displays a message on the operator status panel 124 to stop the insertion of plate pallet adapter 128.

Figure 3:
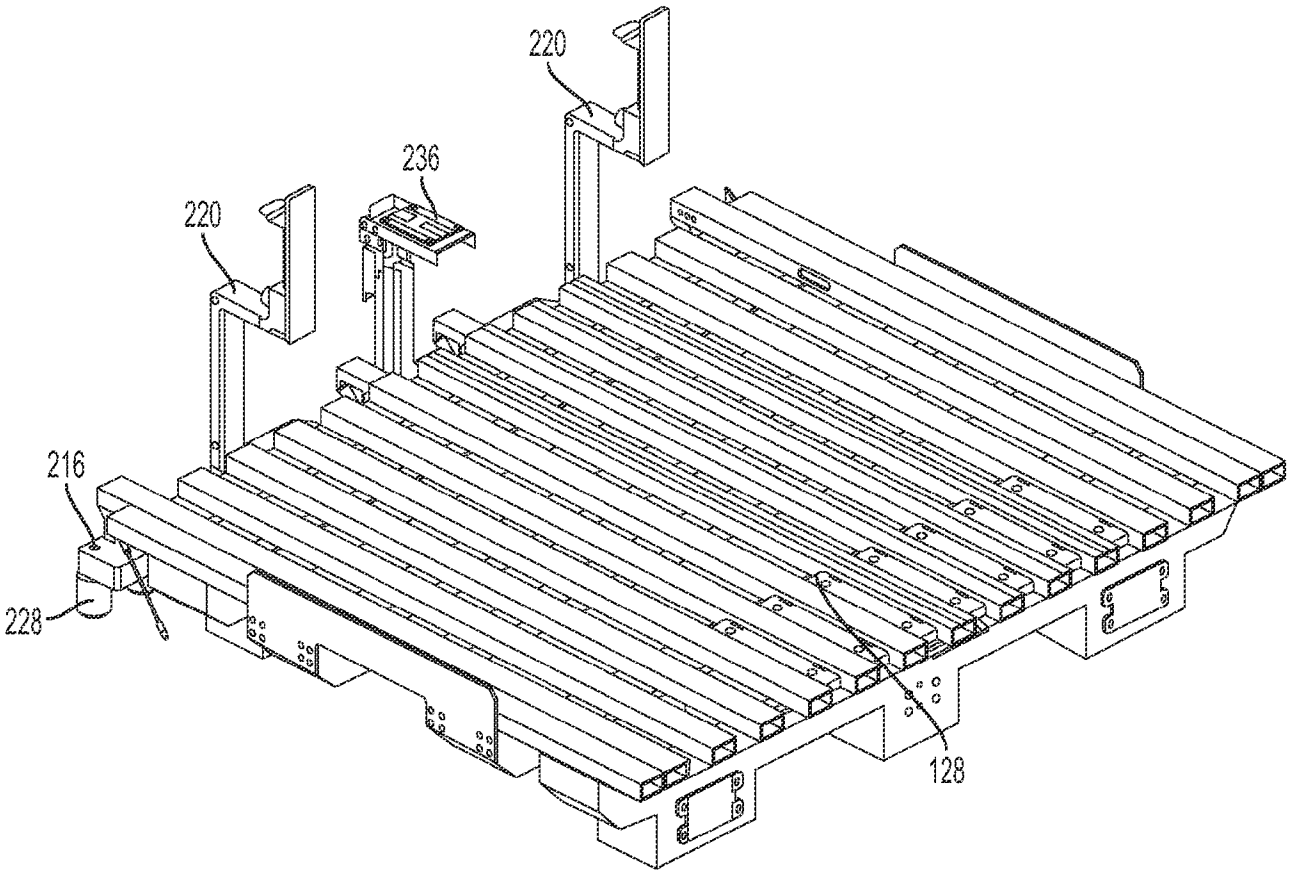
FIG. 3 is a schematic perspective view of a plate pallet adapter with adjustable limiters.
Figure 4:
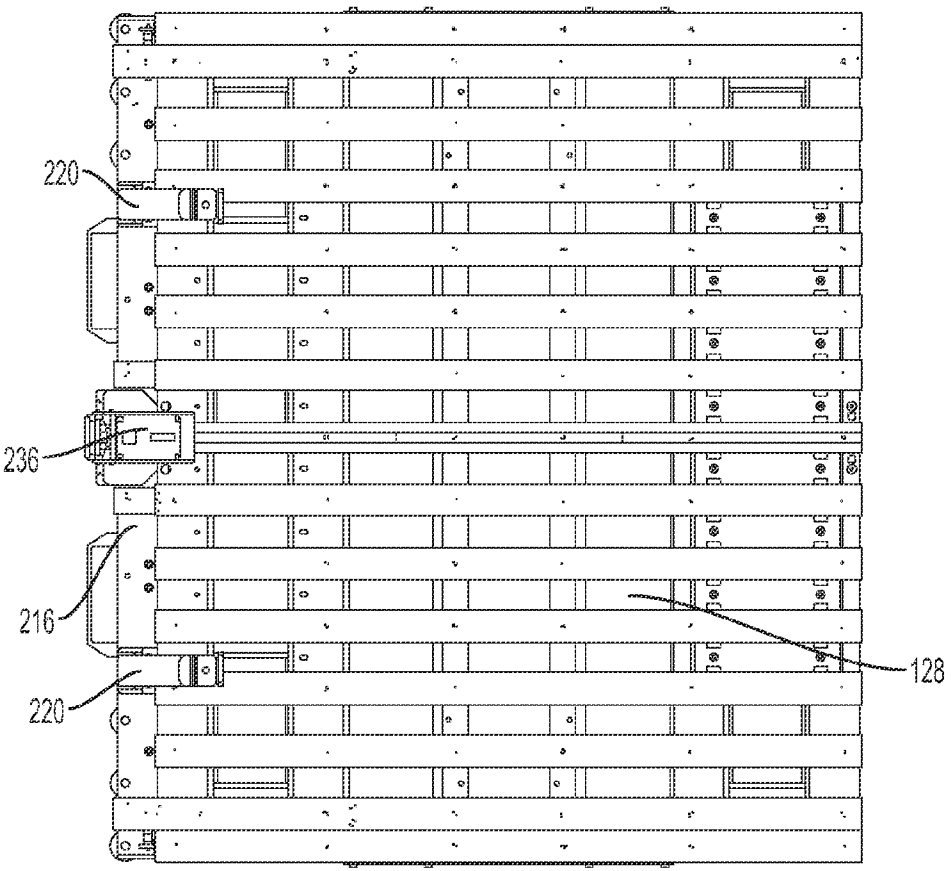
FIG. 4 is a schematic top view of a plate pallet adapter attached to limiters support beam.

FIG. 3 shows a perspective view of plate pallet adapter 128 attached to guiding beam assembly 216 with rollers 228. Front alignment limiters 220 are attached to guiding beam assembly 216. FIG. 4, similar to FIG. 3, shows a top view of plate pallet adapter 128 attached to guiding beam assembly 216. This figure also shows the perpendicular adjustment movement 232 between pallet adapter 128 and guiding beam assembly 216.

Figure 5:
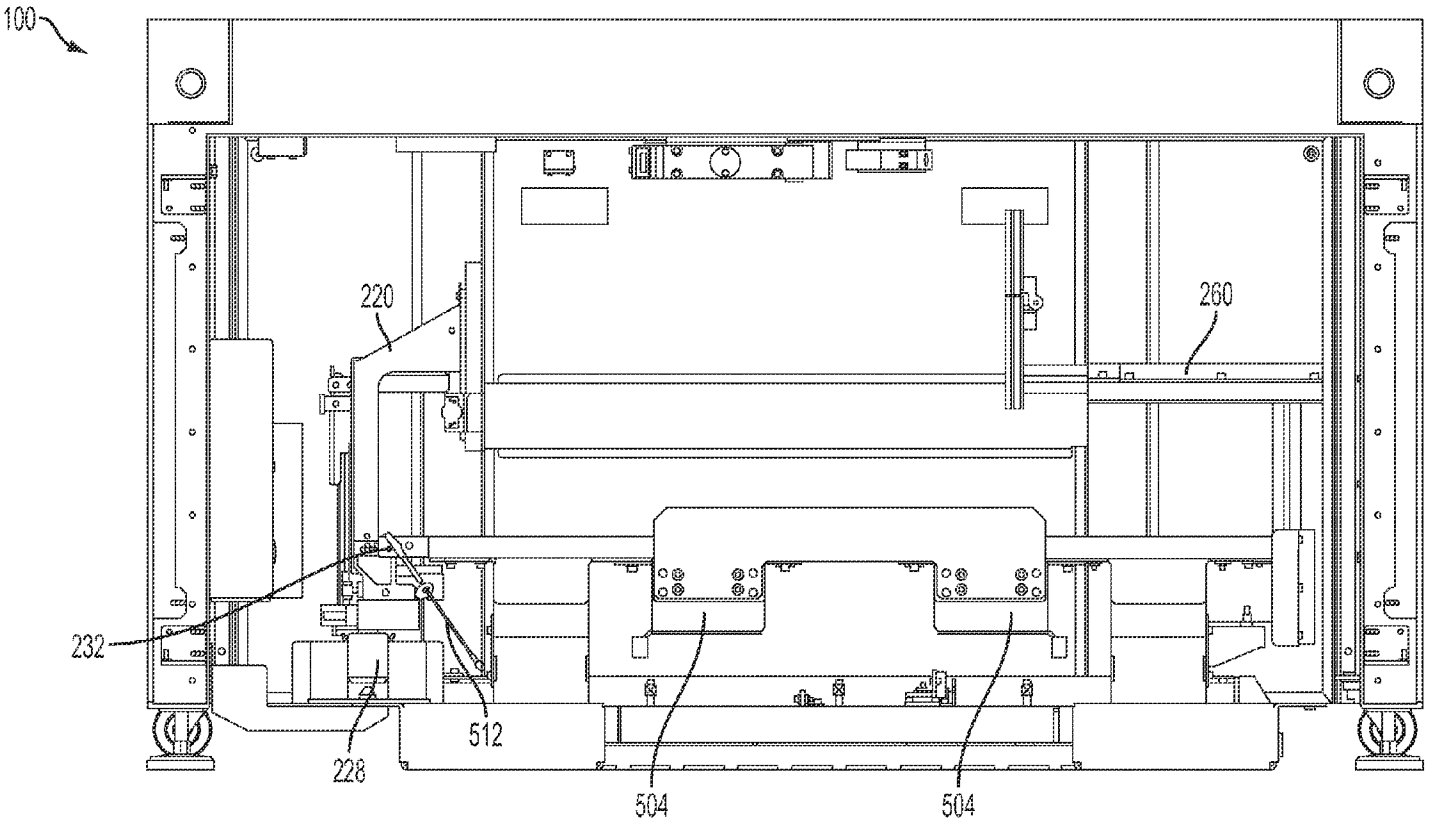
FIG. 5 is a schematic cross-sectional view of a plate pallet adapter.
Figure 6:
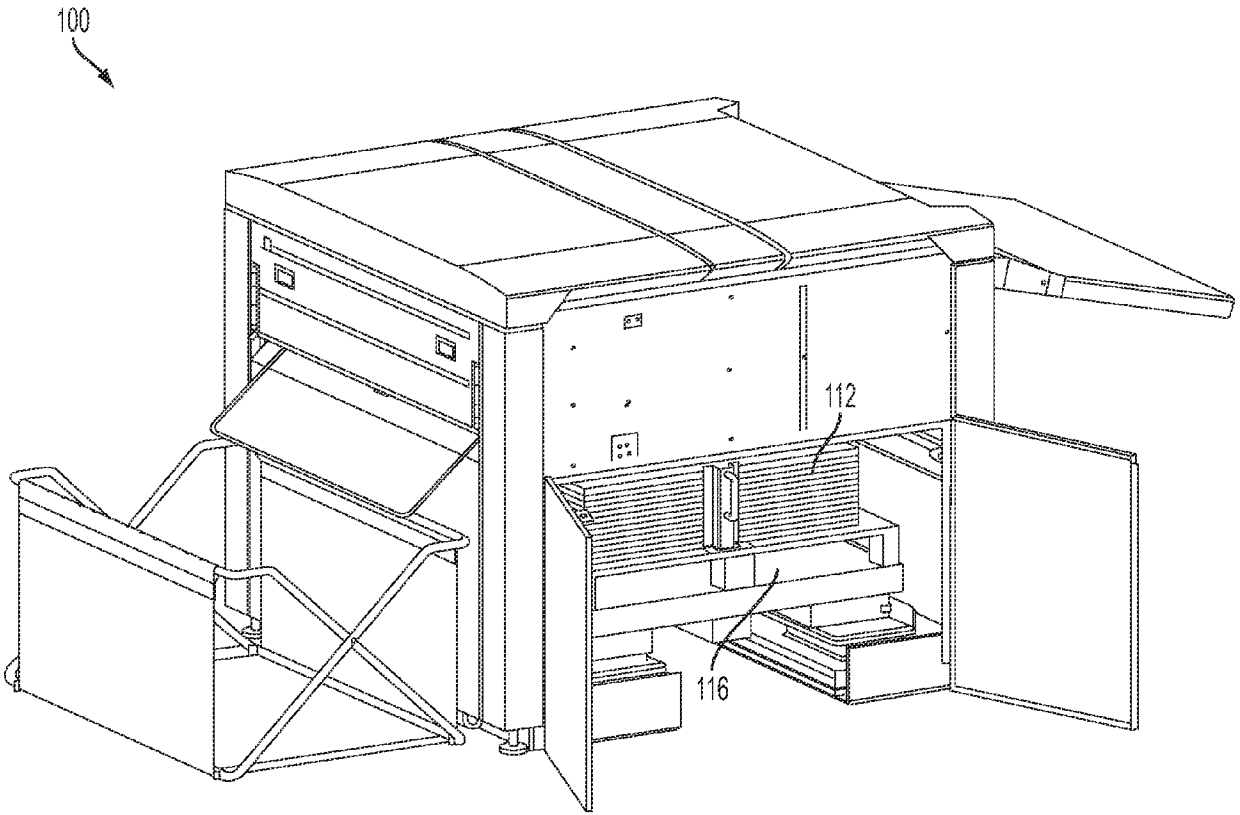
FIG. 6 is a schematic perspective view of an automatic pallet loading system.

FIG. 5 shows a cross sectional view of plate pallet adapter 128. In addition to elements shown in previous figures, it also shows the skids 504, wherein the pallet truck 120 is inserted into the skids 504 for guiding plate pallet adapter 128 into APL 100. FIG. 6 shows a perspective view of APL 100 where plate pallet adapter 128 carrying plate stack 112 on plate pallet 116 is fully inserted into APL 100.

Figure 7:
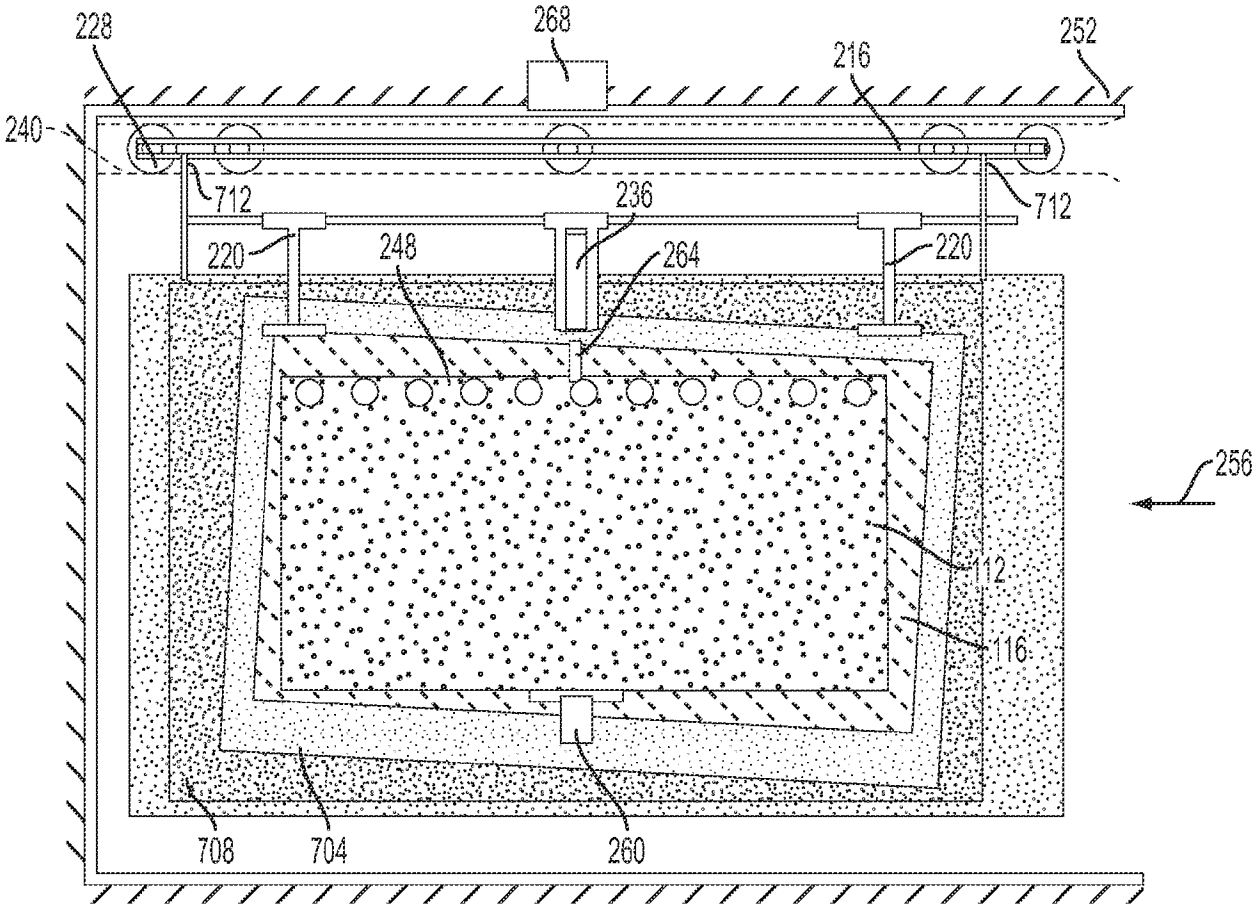
FIG. 7 is a schematic top view of a plate stack on a plate pallet inserted into an automatic plate loader equipped with a ball rollers plate pallet adapter.

FIG. 7 is similar to FIG. 2, however it introduces elements which may facilitate the alignment of plate stack 112 in respect to plate pallet adapter 128, without using a pallet truck as was described before. A floating base 704 is introduced for positioning plate stack 112 on plate pallet 116. The floating base 704 is mounted on plate pallet adapter 128 which is equipped with a sliding surface 708 such as ball rollers based or air bearing surface. Front alignment limiters 220 are fixed to guiding beam assembly 216 by a pair of connecting beams 712. This configuration enables manual alignment of plate stack 112 in respect to plate pick up position 248, by moving the floating base 704 on ball rollers surface 708 of plate pallet adapter 128. In another embodiment of this invention an adjustable parallelogram concept is presented for a plate pallet adapter 128.

Figure 8:
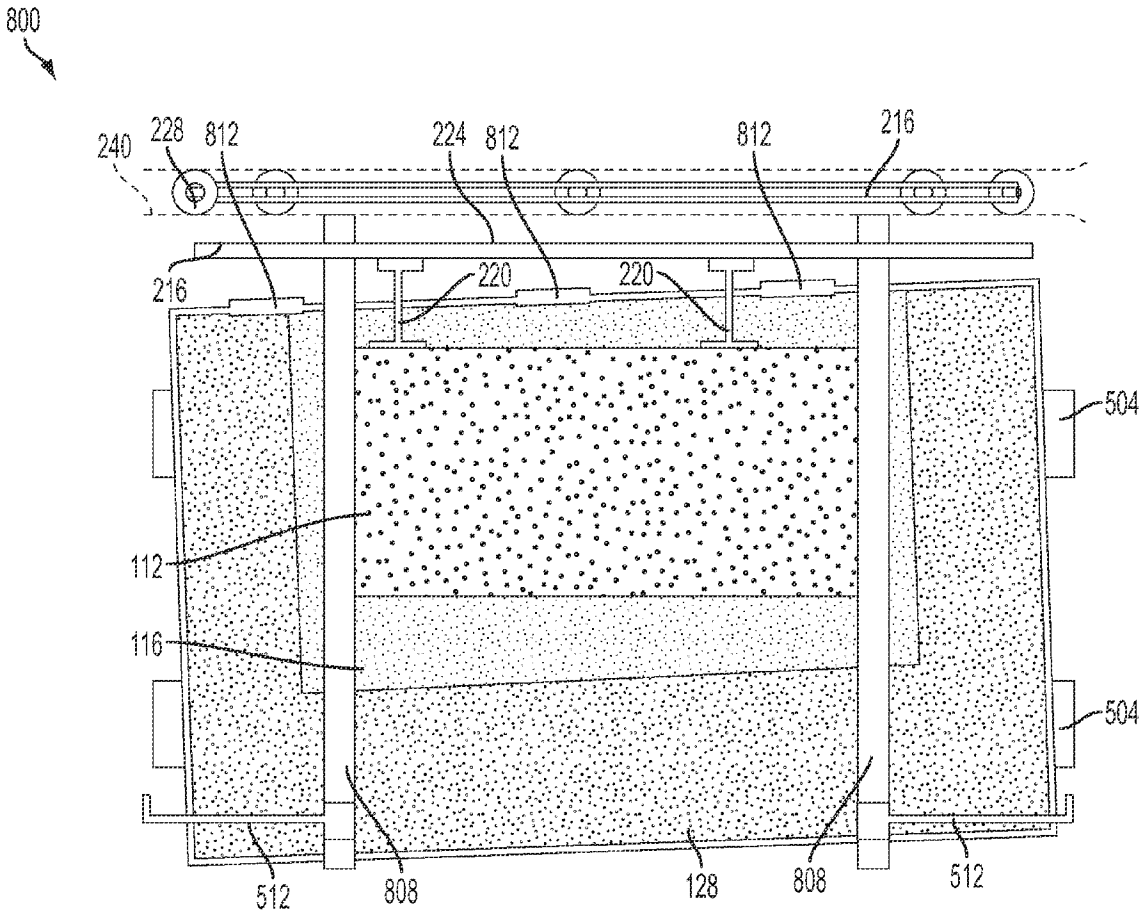
FIG. 8 is a schematic top view of a plate stack on a plate pallet inserted into an parallelogram based plate pallet adapter.
Figure 9:
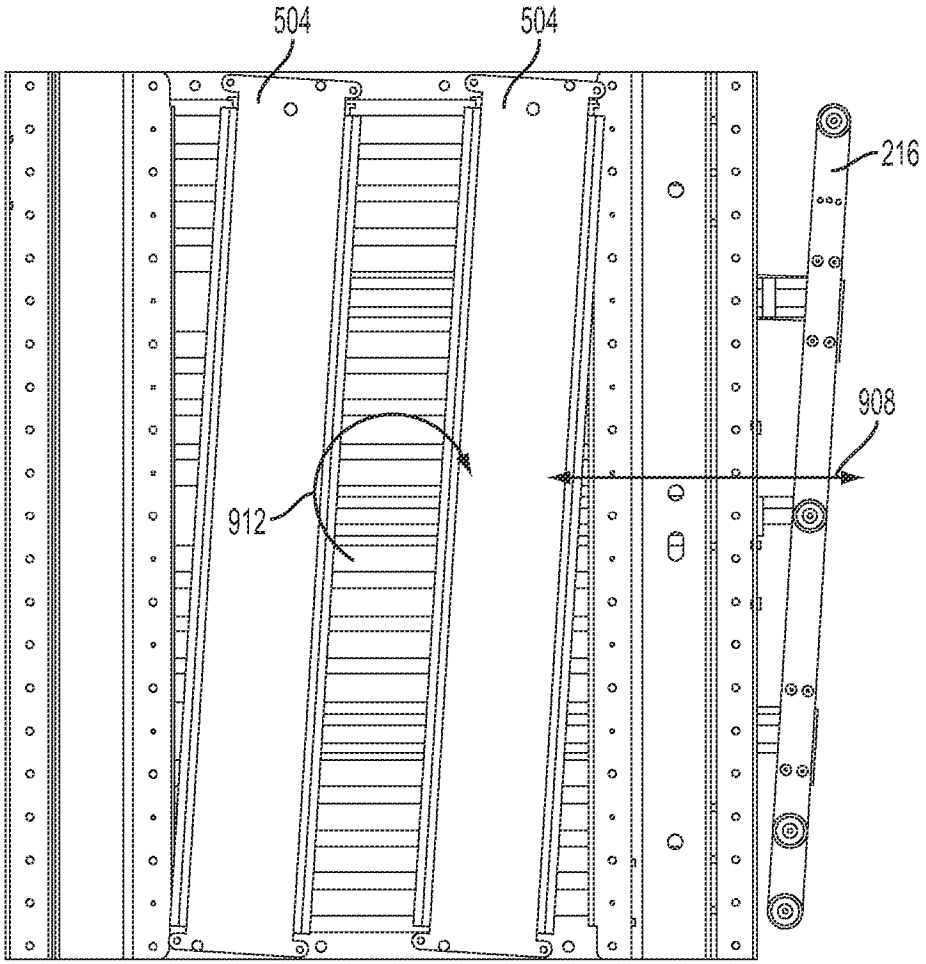
FIG. 9 is a schematic top view of a parallelogram based plate pallet adapter.

FIG. 8 shows plate pallet adapter 128 equipped with adjusting means, allowing skids 504, guiding beam assemblies 216, front alignment limiters 220 and limiter beam 224 to stay parallel to each other, move as one unit in respect to plate stack 112 with plate pallet 116 and are connected by two parallel connecting beams 808, creating a parallelogram configuration 800. Configuration 800 can be adjusted relative to plate pallet adapter 128 in both the Y direction 908 and by angle 912 as is shown in FIG. 9, and is locked after the adjustment is completed by locking device 512. Pallet front barriers 812 are provided to secure plate pallet 116.

The invention has been described in detail with particular reference to certain preferred embodiments thereof, but it will be understood that variations and modifications can be effected within the scope of the invention.

PARTS LIST

100 automatic plate loader (APL) device
104 connecting plate tray
108 imaging device (CTP)
112 plate stack
116 plate pallet
120 pallet truck
124 operator status panel
128 plate pallet adapter
132 forklift
216 guiding beam assembly
220 front alignment limiters
224 limiters beam
228 rollers
232 support beam adjustment perpendicular movement (72 to 106 mm)
236 pallet centering mark
240 slot
244 slide and lock
248 plate pick up position
252 APL chassis
256 loading direction
260 back limiter
264 plate stack center
268 adapter positioning sensor
504 skids
512 locking device
704 floating base
708 plate pallet adapter with ball rollers surface
712 connecting beams
800 parallelogram configuration
808 connecting beams
812 pallet front barrier
820 front limiters adjustment axis
908 slot Y direction adjustment
912 angle adjustment

The invention claimed is:

1. An apparatus for aligning a plate stack and inserting the plate stack into an automatic plate loader in a predefined position comprising:

a plate pallet adapted to carry said plate stack;

a plate pallet adapter adapted to carry said plate pallet;

a centering element attached to said plate pallet adapter configured to align said plate stack in a center position relative to said plate pallet adapter;

a guiding unit attached to said plate pallet adapter configured to be aligned with respect to said plate pallet position and guide said plate pallet adapter into said automatic plate loader;

a plate adapter positioning sensor in said automatic plate loader adapted to sense and notify said pallet adapter reaching said predefined position; and wherein said plate adapter further comprising a floating surface base configured to align said plate pallet relative to said guiding unit.

2. The apparatus according to claim 1 wherein said guiding unit includes a guiding beam with rollers adapted to be inserted into a slot wherein said slot is coupled to said automatic plate loader.

3. The apparatus according to claim 1 wherein said guiding unit further comprises limiters to align and secure said plate stack.

4. The apparatus according to claim 1 wherein said plate adapter positioning sensor notifies the position of said plate pallet in said automatic plate loader on a status panel.

5. An apparatus for aligning a plate stack and inserting the plate stack into an automatic plate loader in a predefined position comprising:

a plate pallet adapted to carry said plate stack;

a plate pallet adapter adapted to carry said plate pallet;

a centering element attached to said plate pallet adapter configured to align said plate stack in a center position relative to said plate pallet adapter;

a guiding unit attached to said plate pallet adapter configured to be aligned with respect to said plate pallet position and guide said plate pallet adapter into said automatic plate loader;

a plate adapter positioning sensor in said automatic plate loader adapted to sense and notify said pallet adapter reaching said predefined position; and wherein said plate adapter further comprising a ball rollers surface configured to align said plate pallet relative to said guiding unit.

6. The apparatus according to claim 5 wherein said guiding unit includes a guiding beam with rollers adapted to be inserted into a slot wherein said slot is coupled to said automatic plate loader.

7. The apparatus according to claim 5 wherein said plate adapter positioning sensor notifies the position of said plate pallet in said automatic plate loader on a status panel.

8. An apparatus for aligning a plate stack and inserting the plate stack into an automatic plate loader in a predefined position comprising:

a plate pallet adapted to carry said plate stack;

a plate pallet adapter adapted to carry said plate pallet;

a centering element attached to said plate pallet adapter configured to align said plate stack in a center position relative to said plate pallet adapter;

a guiding unit attached to said plate pallet adapter configured to be aligned with respect to said plate pallet position and guide said plate pallet adapter into said automatic plate loader wherein all the elements of said guiding unit are adjustable and always form a parallelogram and wherein said elements of said guiding unit comprises of at least one of guiding beams, limiter beams, skids, parallel connecting beams, or a combination thereof; and a plate adapter positioning sensor in said automatic plate loader adapted to sense and notify said pallet adapter reaching said predefined position.

9. The apparatus according to claim 8 wherein said guiding unit includes a guiding beam with rollers adapted to be inserted into a slot wherein said slot is coupled to said automatic plate loader.

10. The apparatus according to claim 8 wherein said plate adapter positioning sensor notifies the position of said plate pallet in said automatic plate loader on a status panel.

* * * * *